US012426710B1

(12) United States Patent
Tassin et al.

(10) Patent No.: US 12,426,710 B1
(45) Date of Patent: Sep. 30, 2025

(54) HINGE MOUNTABLE CABINET

(71) Applicants: Timothy W. Tassin, Naples, FL (US); Christian Tassin, Naples, FL (US)

(72) Inventors: Timothy W. Tassin, Naples, FL (US); Christian Tassin, Naples, FL (US)

( * ) Notice: Subject to any disclaimer, the term of this patent is extended or adjusted under 35 U.S.C. 154(b) by 0 days.

(21) Appl. No.: 18/741,909

(22) Filed: Jun. 13, 2024

(51) Int. Cl.

| | |
|---|---|
| ***A47B 96/16*** | (2006.01) |
| ***A47B 47/00*** | (2006.01) |
| ***A47B 96/14*** | (2006.01) |
| *A47B 97/00* | (2006.01) |

(52) U.S. Cl.
CPC ..... *A47B 96/16* (2013.01); *A47B 47/0091* (2013.01); *A47B 96/1416* (2013.01); *A47B 2097/008* (2013.01)

(58) Field of Classification Search
CPC . A47B 96/16; A47B 47/0091; A47B 96/1416; A47B 2097/008; A47B 87/02; A47B 2230/06; A47B 47/0025
See application file for complete search history.

(56) References Cited

U.S. PATENT DOCUMENTS

| | | | | | |
|---|---|---|---|---|---|
| 773,161 | A * | 10/1904 | Prismeyer | A47B 87/02 | 425/DIG. 107 |
| 2,557,630 | A * | 6/1951 | Brown | A47B 87/02 | 206/509 |
| 2,962,334 | A * | 11/1960 | Dutmers | A47B 47/04 | 312/265 |
| 3,518,728 | A * | 7/1970 | Phillips | A47B 91/00 | 220/23.6 |
| 4,301,636 | A * | 11/1981 | Luria | A47B 47/0025 | 312/111 |
| 8,777,339 | B2 * | 7/2014 | Tassin | A47B 83/00 | 211/119.004 |
| 9,198,324 | B1 * | 11/2015 | Yousif | H05K 7/18 | |
| 9,609,947 | B1 * | 4/2017 | Tassin | A47B 81/00 | |
| 2008/0302279 | A1 * | 12/2008 | Clifton | A47B 47/042 | 108/180 |
| 2012/0328392 | A1 * | 12/2012 | Difante | F16B 13/0808 | 411/342 |
| 2020/0069048 | A1 * | 3/2020 | Derelöv | F16B 12/20 | |

* cited by examiner

*Primary Examiner* — Ko H Chan
(74) *Attorney, Agent, or Firm* — Bryan L. Loeffler, Esq.; LOEFFLER IP GROUP, P.A.

(57) ABSTRACT

A hinge mounted cabinet capable of being broken down into multiple sections to reduce the height, width, and length of the disassembled cabinet for shipping.

1 Claim, 7 Drawing Sheets

HINGE MOUNTABLE CABINET

FIELD OF THE INVENTION

This invention relates to storage devices and, more particularly, to a cabinet that is mountable to one or more existing hinges and hinge pins of a door.

BACKGROUND OF THE INVENTION

Additional storage has always been a desirable commodity in homes and other structures where space is at a premium. One overlooked area in the past has been the space located behind doors. Storage devices have been developed in the past that hang over the upper edge of doors on hooks and/or attach directly to a rear surface of a door with screws, bolts and/or adhesives. However, these devices may damage the door's finish, damage the structural integrity of the door and/or make it difficult for the door to close by interfering with the door jam.

An additional problem with conventional door mounted cabinets is the size and weight of the devices, which make shipping and transportation expensive costs to end users.

Therefore, a need exists for a hinge mounted cabinet that is mountable to one or more existing hinges and hinge pins of a door wherein the cabinet may be broken down into a compact configuration for shipping.

SUMMARY OF THE INVENTION

The primary object of the present invention is to provide a hinge mounted cabinet that is capable of being broken down into multiple disassembled pieces to reduce the height, width, and length of the disassembled cabinet for shipping.

The present invention fulfills the above and other objects by providing a cabinet that is split into a top section and a bottom section that are secured together using plurality of internal support channels that are locked together using a locking shelf that also provides a shelf surface within the cabinet when assembled.

One or more wall anchors may also be provided with the cabinet to allow the cabinet to be mounted to a wall, rather than hinges. The wall anchor provides at least one doughnut-shaped positioning spacer having a top lip or plate that allows the spacer to be seated in one or more pilot holes drilled into a wall. Toggle bolts may then be placed through the spacers, which hold the toggle bolts in a fixed and centered position in the pilot holes.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
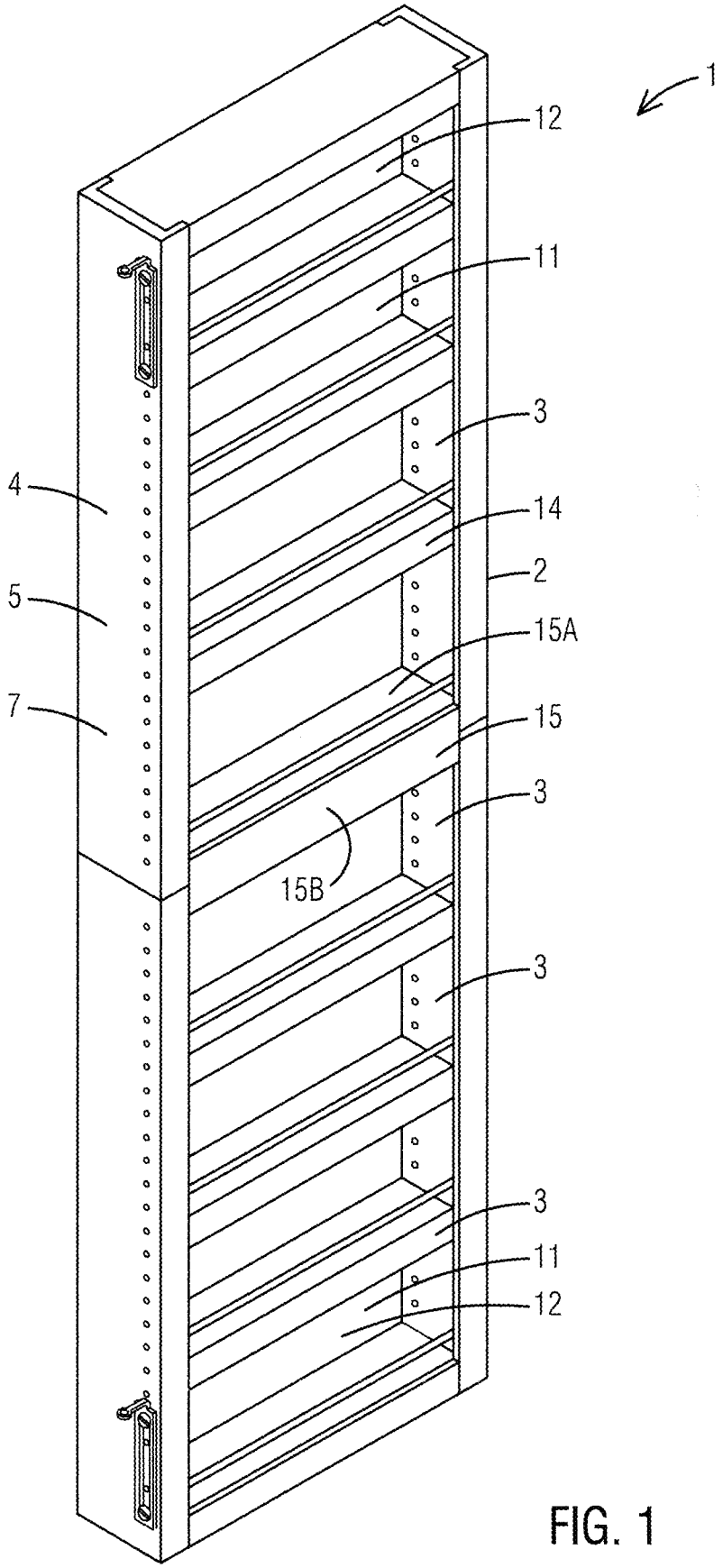
FIG. 1 is a perspective interior side view of an assembled cabinet of the present invention.

For purposes of describing the preferred embodiment, the terminology used in reference to the numbered components in the drawings is as follows:

1. cabinet, generally
2. main body
2A. top section of main body
2B. bottom section of main body
3. interior surface of cabinet
4. exterior surface of cabinet
5. interior side panel of main body
6. interior surface of interior side panel
7. exterior surface of interior side panel
8. exterior side panel of main body
9. interior surface of exterior side panel
10. exterior surface of exterior side panel
11. rear panel
12. interior surface of rear panel
13. exterior surface of rear panel
14. shelf
15. locking shelf
15A. horizontal panel
15B. front vertical plate
15C. back vertical plate
15D. top dado
15E. bottom dado
15F. top screw hole
15G. bottom screw hole
16. wall anchor
16A. plate
16B. tubular-shaped spacer
16C. toggle bolt
17. hinge hanging bracket
18. rectangular plate
19. top of rectangular plate
20. bottom of rectangular plate
21. side of rectangular plate
22. aperture on rectangular plate
23. arm
24. proximal end of arm
25. distal end of arm
26. ring
27. ring aperture
28. wall hanging bracket
29. bolt
30. wall
31. wall hanging bracket aperture With reference to FIG. 1, the cabinet 1 of the present invention comprises a top section 2A and a bottom section 2B, each having an interior surface 3 and an exterior surface 4, an interior side panel 5 having an interior surface 6 and an exterior surface 7, an exterior side panel 8 having an interior surface 9 and an exterior surface 10 and a rear panel 11 having an interior surface 12 and an exterior surface 13. The top section 2A and a bottom section 2B each house an open storage area for placing one or more shelves 14 that extend across the top section 2A and bottom section 2B from the interior side panel 5 to the exterior side panel 8 of each section, respectively. The rear panels 11 may be a flat opaque material, mirrors, pegboard, white boards, chalk boards, cork board, and so forth that fit in dados within the main body 2.

Figure 2A:
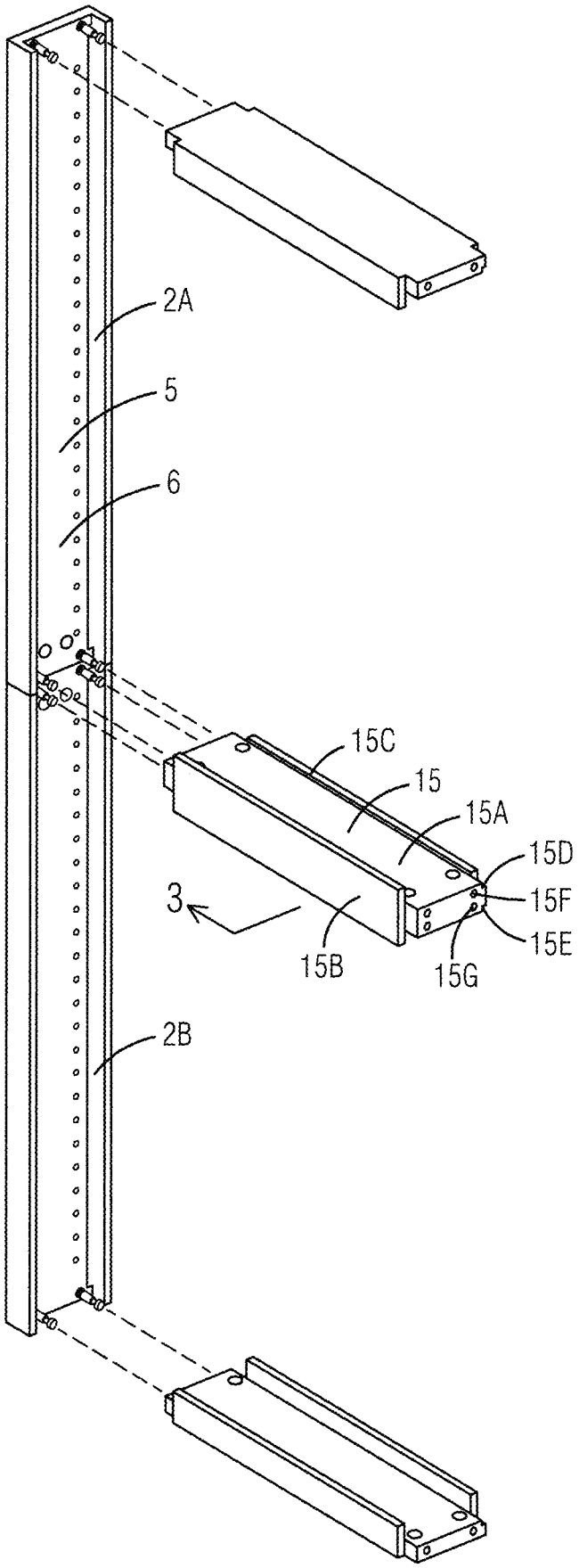
FIG. 2A-2C are perspective exploded views of cabinet of the present invention showing a top section and a bottom section thereof being secured together using a locking shelf of the present invention.
Figure 2B:
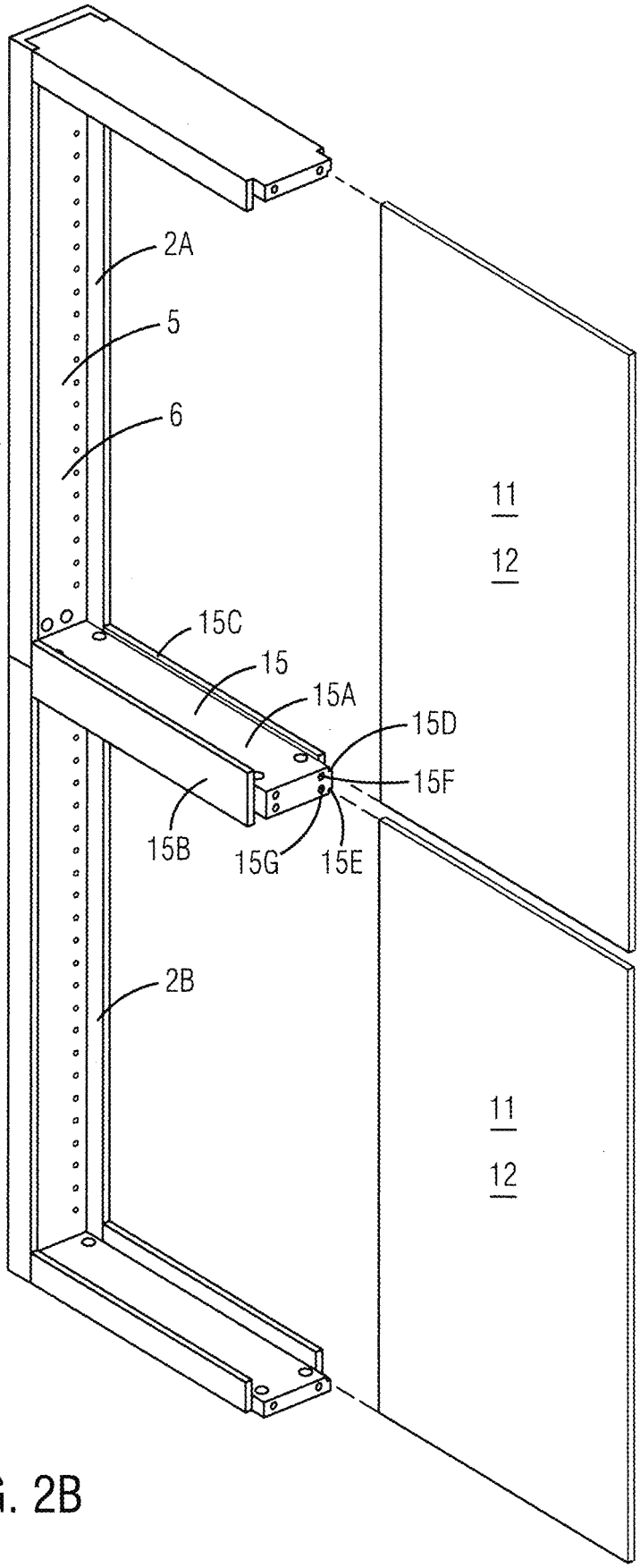

As illustrated in FIG. 2B, the locking shelf 15 allows a user to easily swap out a top rear panel 11A and/or a bottom rear panel 11B by only removing a top exterior side panel 8A and/or a bottom side exterior panel 8B while the rest of the main body 2 remains mounted to a pair of hinges. For example, a user may swap out an opaque rear panel 11 with a rear panel that is a mirror.

Figure 2C:
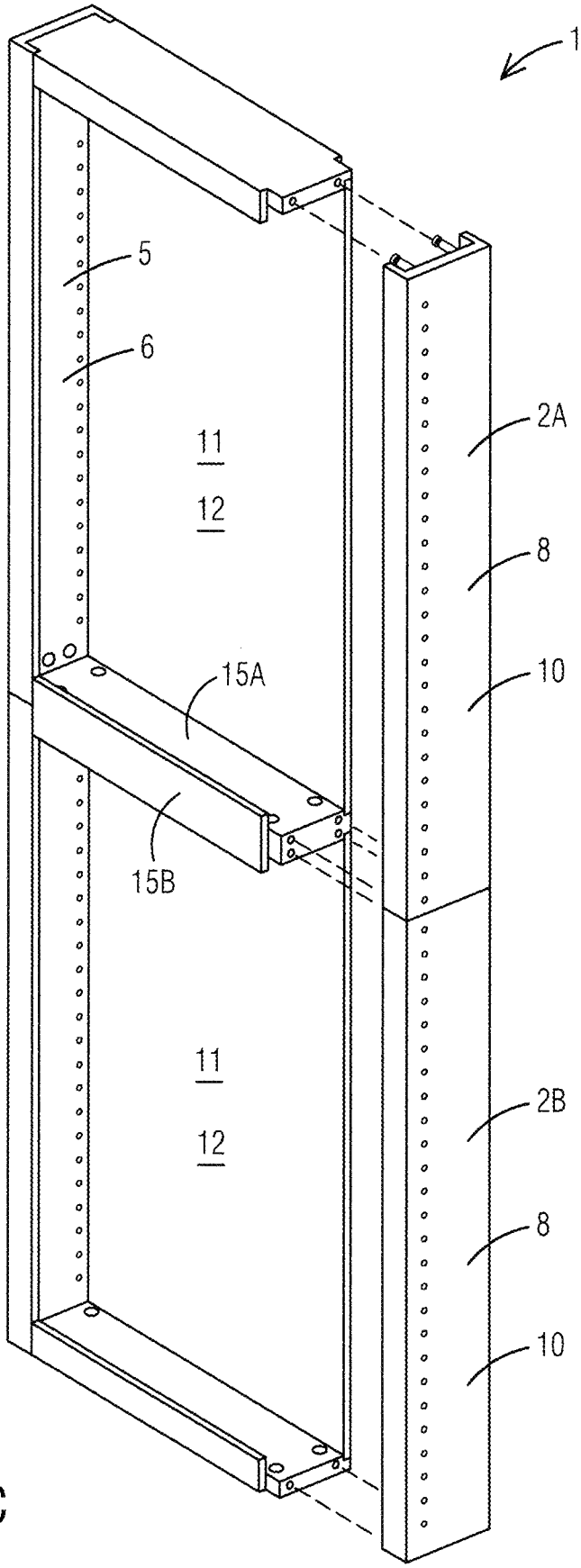
Figure 3:
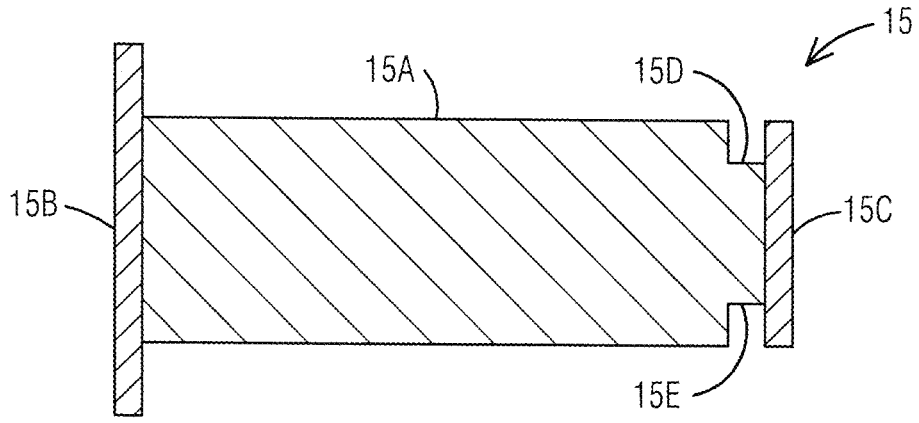
FIG. 3 is a sectional view of a locking shelf along lines 3-3 of FIG. 2A.

As illustrated in FIGS. 2A-C, the top section 2A and bottom section 2B may be attached to each other using a locking shelf 15 wherein the locking shelf 15 comprises an elongated horizontal panel 15A having a front vertical plate 15B and back vertical plate 15C one a front edge and rear edge of the horizontal shelf 15A, respectively, wherein a top dado 15D and a bottom dado 15E are located between the back vertical plate 15C to allow top and bottom rear panels 11 to be inserted in position on the cabinet 1, as illustrated in FIG. 3.

In addition, the locking shelf 15 comprises top screw holes 15F and bottom screw holes 15G located on each end of the horizontal panel 15A, wherein the top screw holes 15F are capable of receiving an attachment means such as screws, bolts, studs, and so forth to secure the locking shelf 15 to the top section 2A of the cabinet 1. Likewise, the bottom screw holes 15G are capable of receiving an attachment means such as screws, bolts, studs, and so forth to secure the locking shelf 15 to the bottom section 2B of the cabinet 1.

Figure 4:
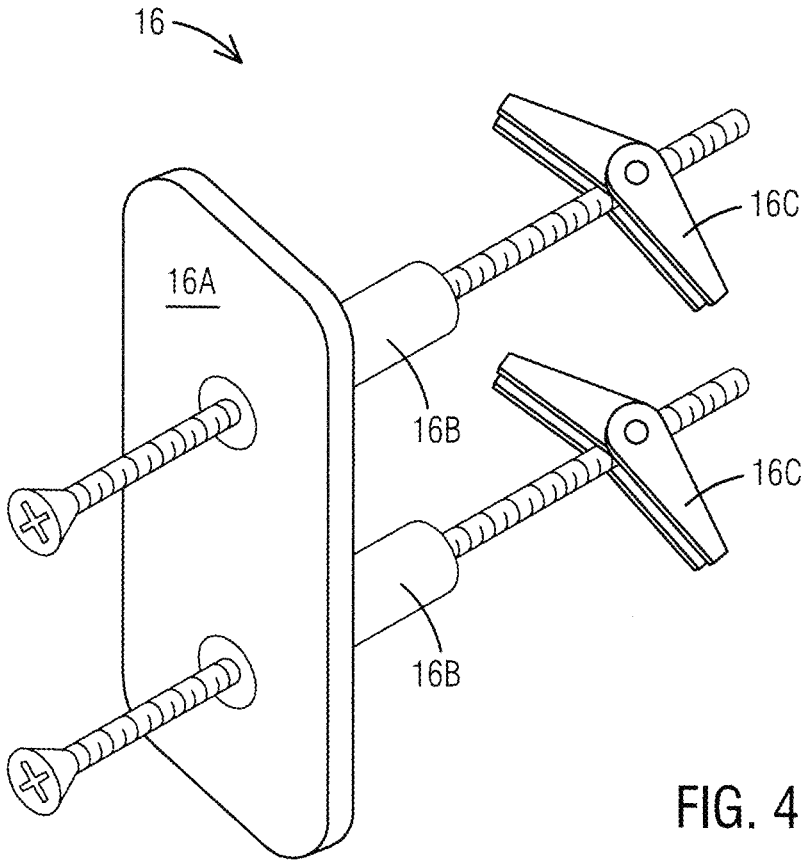
FIG. 4 is a perspective exploded view of a wall anchor of the present invention.

With reference to FIG. 4, a perspective exploded view of a wall anchor 16 of the present invention is illustrated. One or more wall anchors 16 may also be provided with the cabinet 1 to allow the cabinet 1 to be mounted directly to a wall. The wall anchor 16 provides a plate 16A having at least one tubular-shaped spacer 16B extending perpendicularly from the plate 16A. A toggle bolt 16C may be placed though the tubular-shaped spacer 16B so the toggle bole 16C is supported within a pilot hole drilled in the wall while being installed.

Figure 5:
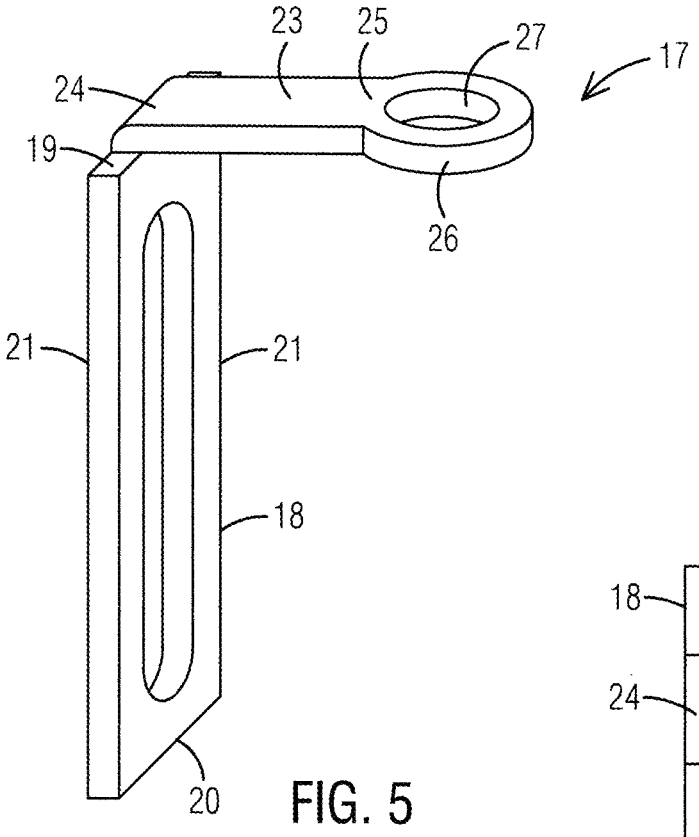
FIG. 5 is a perspective side view of a hinge hanging bracket of the cabinet of the present invention.
Figure 6:
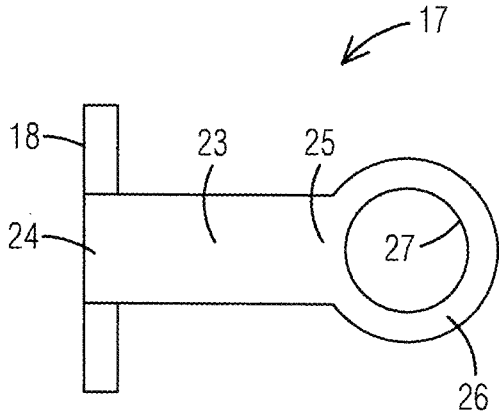
FIG. 6 is a top view of a hinge hanging bracket of the cabinet of the present invention.

With reference to FIGS. 5 and 6, a perspective side view of a hinge hanging bracket 17 of the present invention and a perspective top view of a hinge hanging bracket 17 of the present invention, respectively, are illustrated. The hinge hanging bracket 17 comprises a substantially rectangular-shaped plate 18 having a top 19, bottom 20, and sides 21. At least one aperture 22 is located on the substantially rectangular-shaped plate 18. An arm 23 having a proximal end 24 and distal end 25 extends from the top of the substantially rectangular-shaped plate 18. A ring 26 and aperture 27 are located on the distal end 25 of the arm 23. An additional feature of the hinge hanging bracket 17, is that the arm 23 has a width that is less than a diameter of ring 26 and the distal end 25 of the arm 23. The width of the arm 23 provides clearance from obstructions, such as hinge plates, molding and so forth, so the hinge hanging bracket 17 can be swung back and forth a full 180 degrees in relation to a closed door and a parallel wall.

Figure 7B:
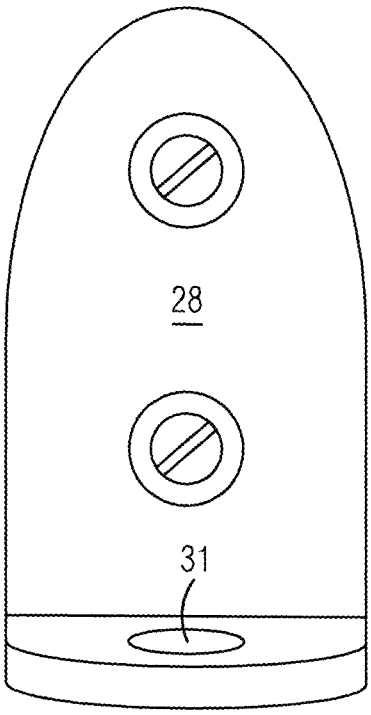
FIG. 7B is a front view of a wall hanging bracket of the present invention.
Figure 7A:
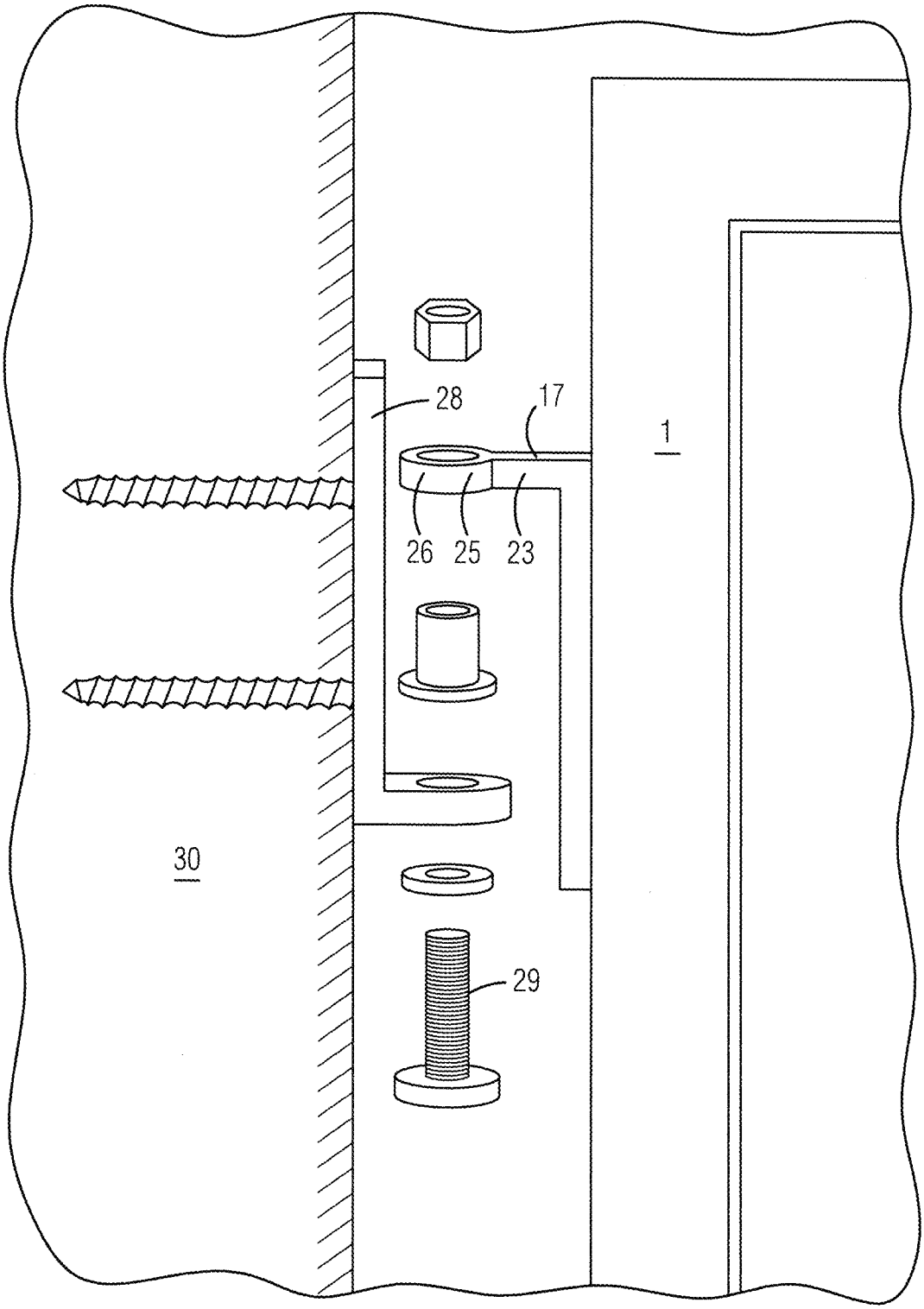
FIG. 7A is a front plan view of a cabinet of the present invention being installed on a wall instead of a pair of hinges.

With reference to FIGS. 7A and 7B, a front plan view of a cabinet 1 of the present invention being installed on a wall 30 is illustrated. The hinge hanging bracket 17 may also be used with a wall hanging bracket 28 instead of a door hinge. The wall hanging bracket 28 is an L-shaped bracket that attaches to a flat surface, such as a wall 18 or a door face, using screws and/or bolts. A stud or bolt 29 is used to connect the ring 26 and the distal end 25 of the arm 23 to the wall hanging bracket 28, which has an aperture 31 located thereon for receiving the stud or bolt 29.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

We claim:

1. A cabinet that is mountable to hinges having hinge pins used to hang a door hung in a door jam so that said cabinet can be pivoted upon the hinge pins independently of the door, said cabinet comprising:

a main body having an interior side panel having an interior surface and an exterior surface, an exterior side panel having an interior surface and an exterior surface and a rear panel having an interior surface and an exterior surface;

said main body having a top section and a bottom section each having an open storage area for placing one or more shelves that extend across the cabinet from the interior side panel to the exterior side panel;

said top section and said bottom section being attached to each other by a locking shelf wherein the locking shelf comprises a horizontal panel having a front vertical plate located on a front edge of the horizontal panel and a back vertical plate located on a rear edge of the horizontal panel; and a top dado and a bottom dado located between the back vertical plate and the horizontal panel;

said locking shelf having top screw holes and bottom screw holes located on each end of the horizontal panel.

* * * * *